United States Patent [19]

Rink

[11] 4,135,947

[45] Jan. 23, 1979

[54] METHOD OF CLEANING SURFACES WITH $CO_2$-NEUTRALIZED AMINE COMPOSITIONS

[75] Inventor: Donald R. Rink, Yorktown Heights, N.Y.

[73] Assignee: Union Carbide Corporation, New York, N.Y.

[21] Appl. No.: 789,925

[22] Filed: Apr. 22, 1977

[51] Int. Cl.[2] ..... B08B 3/08; B08B 3/10

[52] U.S. Cl. ..... 134/4; 134/22 R; 134/30; 134/38; 134/39; 134/40; 252/90; 252/153; 252/154; 252/155; 252/544

[58] Field of Search ..... 134/4, 6, 30, 38, 39, 134/40, 22 R; 252/90, 544, 153, 154, 155, 156, 305

[56] References Cited

U.S. PATENT DOCUMENTS

| | | | |
|---|---|---|---|
| 3,546,124 | 12/1970 | Fleischer | 252/153 |
| 3,615,825 | 10/1971 | Gansser | 252/544 X |
| 3,658,711 | 4/1972 | Mukai et al. | 252/156 X |
| 3,804,771 | 4/1974 | Margolis | 252/90 X |
| 3,827,983 | 8/1974 | Mitchell et al. | 134/40 X |
| 3,829,387 | 8/1974 | Wise et al. | 252/544 X |

OTHER PUBLICATIONS

Woertz, Can. J. Chem. Eng., "Experiments with Solvent-Amine-Water for Removing $CO_2$ from Gas", vol. 50, Jun. 1972, pp. 425-427.

Barkar et al., Chem. Abs., Abstract No. 111459c, vol. 80, 1974, p. 199.

Tsanov et al., Chem. Abs., Abstract No. 174083s, vol. 81, 1974, p. 288.

*Primary Examiner*—Marc L. Caroff

*Attorney, Agent, or Firm*—Robert C. Brown

[57] ABSTRACT

Organic coatings or deposits are removed from a surface, such as an oven surface, by applying to the coating an aqueous composition containing a primary or secondary amine neutralized with an amount of carbon dioxide in the composition sufficient to cause the composition to have a pH of 10 or less, subjecting the applied composition to conditions whereby partial pressure of carbon dioxide acting on the composition is less than the partial pressure of carbon dioxide in the composition at the temperature of use, and thereafter mechanically removing the coating. The composition may optionally contain a water-soluble organic solvent or a thickening agent.

19 Claims, 1 Drawing Figure

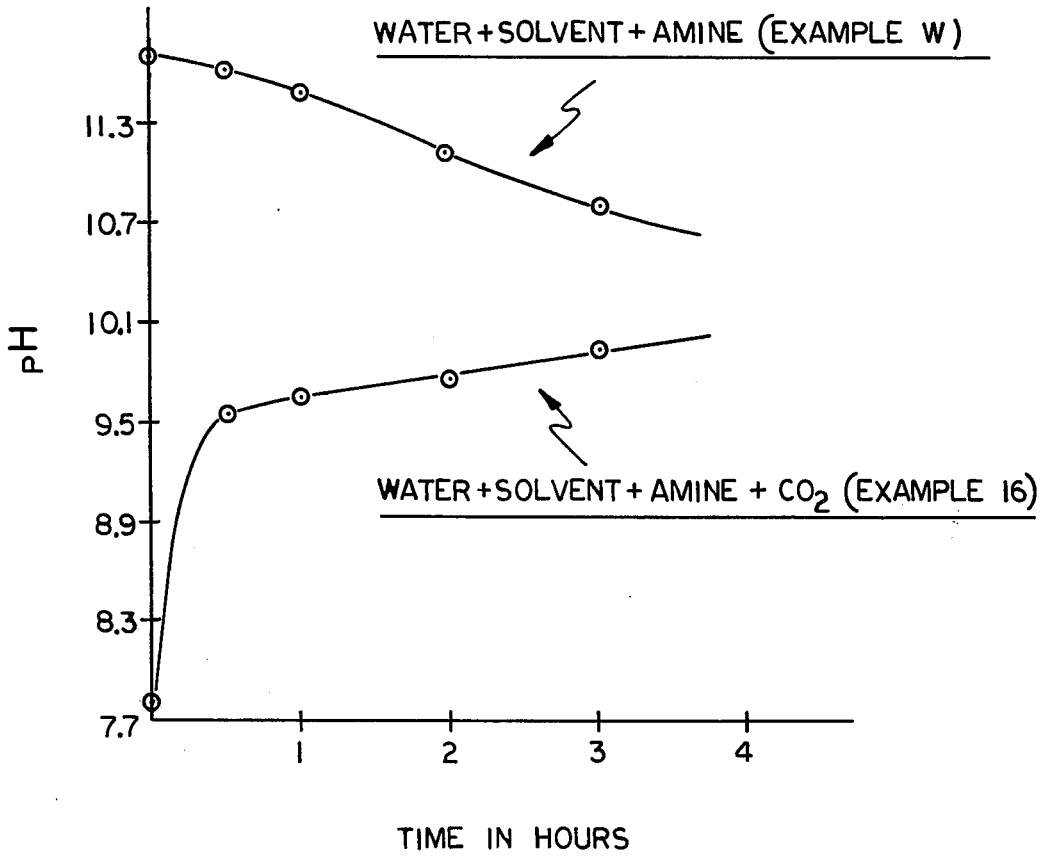
WATER + SOLVENT + AMINE (EXAMPLE W)
WATER + SOLVENT + AMINE + $CO_2$ (EXAMPLE 16)
pH
11.3
10.7
10.1
9.5
8.9
8.3
7.7
1
2
3
4
TIME IN HOURS

METHOD OF CLEANING SURFACES WITH $CO_2$-NEUTRALIZED AMINE COMPOSITIONS

BACKGROUND OF THE INVENTION

1. Field of the Invention

This invention relates to novel compositions for the softening and/or loosening of unwanted organic coatings for removal from surfaces, such as oven surfaces which are soiled by baked-on organic or carbon deposits. This invention also relates to methods of making these novel compositions and to methods of using them. Other unwanted organic coatings which can be softened or loosened for removal by the compositions of this invention include organic paint, varnish, shellac or lacquer coatings that are desired to be stripped from surfaces to which they are applied.

2. Description of the Prior Art

The job of periodically cleaning soil from interior surfaces of home ovens or commercial food ovens or cooking utensils often is disagreeable. The soil normally has been baked-on by several heatings between the time it was deposited and the time that its removal is attempted and, therefore, is difficult to remove. Mechanical removal as by chipping with a tool or scrubbing with abrasives is arduous, potentially hazardous to the surface and/or the worker and usually is not very effective. Two currently popular means for removing soils of this type are (a) the self-cleaning oven which uses extremely high temperatures and catalytic oven surfaces to oxidize and burn off the soil and (b) the application of a cleaner which dissolves, softens and/or lifts the soil from the surfaces. Most of the oven cleaners currently being marketed contain strong caustic or alkaline materials which can cause severe burns and tissue damage if they contact the skin or eyes and there is a high level of interest in safer oven cleaning compositions.

As illustrated by U.S. Pat. Nos. 3,031,408; 3,031,409; 3,079,284; 3,196,046; 3,331,943; 3,335,092; 3,549,419; 3,684,576; 3,715,324; 3,779,933; 3,829,387 and others, oven interiors soiled by baked-on grease and spattered foods have been cleaned by applying solutions of saponification agents or materials that provide ammonia gas which condenses on the oven walls, usually preceded or followed by heating of the soiled interiors in order to cause a chemical reaction with the soil. However, the use of these solutions is accompanied by certain drawbacks, such as, harsh fumes emanating from the oven, and/or they are harmful to the eyes and skin on contact due to caustic. These solutions are also capable of producing corrosive damage to aluminum surfaces, if accidentally spilled on them.

Products containing catalytic metal salts and oxides are also described which substitute for catalytic coatings in self-cleaning ovens. These coatings require higher than normal cooking temperatures in order to be operable.

U.S. Pat. No. 3,658,711 discloses oven cleaning compositions containing an alkali metal or ammonium carbonate, phosphate, borate or silicate and a polyoxyethylene glycol amine enhancer. While these compositions avoid the use of caustic alkalis, the amine contributes to a higher pH and presents the possibility of injury to the skin or tissue. Alkali metal carbonates are themselves quite stable and will not convert to alkali metal hydroxides under the conditions of oridinary use and, thus, are lacking in cleaning ability.

U.S. Pat. No. 3,808,051 describes oven cleaning compositions containing salts of mixed alkali metals and a volatile weak organic acid. The salt mixtures become molten at elevated temperatures and the weak organic acid moiety volatilizes to release alkali metal ions which attack the soil. Thereafter, the soil residue is washed from the surface. These compositions require relatively high temperatures to become operable and cannot function at room temperature. Furthermore, during washing to remove the soil, the user is faced with the potential hazards of removing and handling caustic alkalis.

SUMMARY OF THE INVENTION

The present invention is based, in part, on the discovery that effective, safer cleaning compositions can be made from organic amines, that attack unwanted organic coatings on surfaces desired to be cleaned, by neutralizing an aqueous solution of the amine with carbon dioxide. The amine solution is thus rendered substantially less corrosive to the eyes or skin than the amines themselves or the caustic alkalis and other strongly alkaline materials employed by the prior art. The organic amine solutions neutralized with $CO_2$ forming the cleaning compositions of this invention are sufficiently unstable when applied as an over-coating on the unwanted coating, that a reduction in partial pressure of carbon dioxide acting on the composition, either by heating and/or by standing open to the atmosphere of a relatively large enclosure, e.g., a room or oven, liberates $CO_2$ leaving the free organic amine which then acts on the unwanted coating to loosen, soften and/or make it more amenable to mechanical removal, as by rinsing, wiping or scraping. It was also unexpectedly discovered that the pH of the neutralized organic amine solutions are far below the normal pH of the unneutralized aqueous solutions of the organic amine itself and that the pH of the composition over-coating does not elevate to the normal pH of the unneutralized solution of organic amine as $CO_2$ is released during the cleaning operation. This phenomenon is shown by the plot of the drawing and is distinct from the action of prior art materials which contain caustic or highly alkaline substances and have high pH's throughout the cleaning operation. Consequently, the compositions of this invention are not only safer during application but they are also safer during removal.

Accordingly, the present invention relates to the loosening or softening of unwanted organic coatings bonded to a surface by the application to the coatings of an aqueous amine solution neutralized with $CO_2$, said solution being capable of decomposing to release the $CO_2$ leaving the amine when subjected to conditions wherein the partial pressure of carbon dioxide acting on the solution is less than the partial pressure of carbon dioxide of the solution at the temperature and $CO_2$ partial pressure in the atmosphere in which the composition is used to clean the surface, the amine preferably having a boiling point in excess of the temperature at which the composition is used for cleaning the surface and being capable, alone or in conjunction with a water-soluble organic solvent, of loosening or softening the unwanted coating on the surface. The invention includes cleaning compositions containing the above-described aqueous solutions and thickening agents for increasing viscosity to facilitate the adherence of the compositions to inclined and vertical surfaces and ceilings and/or water-soluble organic solvents to assist in the loosening or softening action. The invention also includes novel aerosol products containing the novel compositions and to novel methods of preparing the novel compositions.

BRIEF DESCRIPTION OF THE DRAWING

The drawing is a plot of pH versus time in hours of two compositions applied as an over-coating to baked-on cooking soil and kept in a 90° C. oven to illustrate the pH of the applied composition at various points in time after application over a three hour period. (See Examples 16 and HHH). The compositions are identical except that the one illustrating the invention (Example 16) was neutralized with $CO_2$ before application. The plot shows that throughout the three hour period after application of the novel composition as an over-coating, the pH of the novel composition over-coating never exceeded 10 whereas the pH of the over-coating which contained no $CO_2$ was at all times in excess of 10.

DESCRIPTION OF THE PREFERRED EMBODIMENTS

The novel compositions of this invention are based on aqueous solutions of $CO_2$-neutralized solutions of water-soluble organic amines. Methods of preparing aqueous solutions of this type are well known in the art and involve the reaction of carbon dioxide with the amine in aqueous solution. The reaction can be carried out by mixing carbon dioxide in gaseous or solid form with the aqueous amine solution until the reaction has proceeded to the desired extent. Any reaction conditions can be employed, although low temperatures such as room temperature or lower facilitate the dissolution of the carbon dioxide in the aqueous amine solution for reaction with the amine. Higher temperatures can be used; however, they tend to increase the partial pressure of carbon dioxide of the solution, slow the entry of additional carbon dioxide into the solution and consequently tend to retard the neutralization and impede the reduction of pH. Gentle to moderate stirring or mixing, of course, serves to facilitate the dissolution of carbon dioxide and aids in accelerating the reaction. The initial pH of the aqueous amine solution is usually in excess of 11 and the reaction with carbon dioxide can be continued until the pH of the solution drops to 10 or below, preferably 8 or below. Most preferably the pH is reduced as close to 7 as possible. The resulting aqueous solution, with or without the addition of other ingredients, then can be packaged in a container which is capable of maintaining a partial pressure of at least one atmosphere carbon dioxide at room temperature acting on the solution greater than the partial pressure in the solution over the temperature range to which the container can be expected to be subjected. Suitable containers are gas-tight jars, bottles or cans for application by brush, sponge, cloth, mop etc. or aerosol containers for application by spraying.

The water-soluble organic amines used in this invention are those that are capable, alone or in conjunction with water-soluble organic solvents, of loosening or softening the unwanted coating. Preferably, they have boiling points in excess of the temperature at which the composition is used for loosening or softening the unwanted coating on the surface being cleaned. These water-soluble organic amines are capable of forming carbonates and/or bicarbonates and/or other compounds with carbon dioxide in aqueous solution which carbonates and/or bicarbonates and/or other compounds are capable of decomposing to said amine and carbon dioxide when subjected to conditions wherein the partial pressure of carbon dioxide acting on the solution is less than the partial pressure of carbon dioxide in the solution at the temperature at which the composition containing it is used to clean the surface. Without intending to be bound to any particular theory or mechanism of reaction, it is believed that the formation of the novel $CO_2$-neutralized aqueous amine solutions of this invention can be depicted by the following equations, $R_3N$ representing the water-soluble organic amine wherein one or two of the R's can be hydrogen and one or two of three R's individually can be organic groups or two R's taken together comprise an organic group:

$$2R_3N + 2H_2O \rightleftarrows 2R_3NH^+ + 2OH^-$$

$$CO_2 + H_2O \rightleftarrows H^+ + HCO_3^-$$

$$HCO_3^- \rightleftarrows H^+ + CO_3^=$$

Each of the reactions depicted above is reversible. The reactions involving carbon dioxide and the carbonate and bicarbonate ions can be biased to the right by raising the partial pressure of carbon dioxide acting on the amine solution above the partial pressure of carbon dioxide of the solution which is proportional to the amount of bicarbonate and carbonate ions present in the solution. This is conveniently done by increasing the amount of carbon dioxide in contact with the solutions, e.g., by increasing the amount of dry ice or gaseous carbon dioxide added to the solution, that is, in general, causing an increase in the partial pressure of carbon dixode acting on the solution. These reactions are forced to the right during the manufacture of the novel cleaning solutions and are forced to the left when the compositions containing the solutions are used. These reactions are conveniently forced to the left by increasing the temperature of the solution or by decreasing the partial pressure of carbon dioxide acting on the solution.

Any water-soluble organic amine as described above can be employed. Preferred amines are those that have low or no irritating or toxic properties and have low or no odor or have a pleasant odor. Illustrative of suitable water-soluble organic amines include those having at least one nitrogen-bonded hydrogen atom per molecule and, preferably, those having at least two nitrogen-bonded hydrogen atoms per molecule. Such illustrative organic amines can be depicted by the formula:

$$R'R''NH$$

wherein R' individually can be hydrogen or a monovalent organic group, R'' individually can be a monovalent organic group, and both R' and R'' together can be a divalent organic group. Preferably, R', when it is organic, and R'' are composed of elements selected from the class consisting of carbon, hydrogen, oxygen and nitrogen and most preferably are composed of elements selected from the class consisting of carbon, hydrogen and oxygen. Preferably, R', when organic, and R'' are aliphatic or cycloaliphatic and, most preferably, are selected from the class consisting of alkyl, hydroxyalkyl, and, when taken together, alkylene and alkyleneoxy-alkylene. The number of carbon atoms in R', when organic, and R'' individually is preferably 1 to 18, most preferably 2 to 16, and, when together, is preferably 3 to 18, most preferably 4 to 10.

Specific water-soluble organic amines include monoethanolamine, diethanolamine, n-butylamine, morpholine, 2-[2-(3-aminopropoxy)ethoxy]ethanol, N(2-hydroxyethyl) ethylenediamine, dihexylamine, diisopropylamine, dipropylamine, cyclohexylamine, ethylenediamine, n-amylamine, trimethylene diamine, phenylenediamine, and the like. The proportion of the $CO_2$-neutralized water-soluble organic amine in the novel compositions is not narrowly critical and is conveniently measured by the proportion of the water-soluble organic amine used to produce the novel compositions and available upon decomposition of the novel compositions. The proportion of amine used in producing the novel compositions can range from about 1 wt.% to about 20 wt.%, preferably about 8 wt.% to about 12 wt.%, based on the total weight of the water, amine, and water-soluble solvent, if any, in the composition.

The compositions of this invention can also contain a water-soluble organic solvent to aid in the removal of the unwanted coating such as grease from an oven surface. It should be one having a boiling point above the temperature at which the composition is used, should not adversely affect the other ingredients, should not itself be adversely affected by the other ingredients, should not react with carbon dioxide or interfere with the reaction of carbon dioxide and the amine, and should not present a fire hazard. In many cases, the water-soluble organic solvent has been found to unexpectedly act synergistically with the amine in attacking the unwanted coating. That is, an amine which has little effect on the unwanted coating, when combined according to this invention with certain water-soluble organic solvents which have little or no effect on the unwanted coating, provide compositions that efficiently loosen and/or soften the unwanted coating. In addition to aiding the attack on the unwanted coating, the water-soluble organic solvent, if properly selected, can decrease the rate of evaporation of the amine and water from the unwanted coating to which it is applied. The water-soluble organic solvent can be mixed into composition before or after the water-soluble organic amine is converted to neutral form by treatment with carbon dioxide. It must of course be chosen with regard to its toxicity and compatibility with the other components of the compositions. Odor is of course also a significant consideration, particularly where the solutions are to be used in domestic applications. Suitable organic solvents include alkanols, dialkyl ketones, polyoxyalkylene glycols and alkyl ethers thereof, and alkyl esters of alkanoic acids. Examples of suitable organic solvents are 2-(2-butoxyethoxy)ethanol, triethylene glycol monobutyl ether, triethylene glycol monomethyl ether, a mixture of 70 wt. parts 2-phenoxyethanol and 30 wt. parts 2-(2-phenoxyethoxy)ethanol, 1-butoxy-2-ethoxypropanol, hexylene glycol, tripropylene glycol monomethyl ether, 2-methoxy-1-methylethanol, ethylene glycol, diethylene glycol, triethylene glycol, propylene glycol, 2-(2-methoxyethoxy)ethanol, 2-methoxyethanol, 2-(2-ethoxyethoxy) ethanol, 2-methyl-2,4-pentanediol, glycerol, ethanol, and butanol.

The proportion of water-soluble organic solvent, if used, is not narrowly critical and can range from about 0 wt.% to about 50 wt.%, preferably from about 5 wt.% to about 20 wt.% based on the total weight of water, amine and water-soluble organic solvent in the novel compositions.

Thickening agents can be used in the compositions of this invention to provide body to the compositions, i.e., to render them more viscous and help them to stick to the surface being cleaned, for example, the walls and ceilings of cooking ovens. The thickening agent should be generally compatible with the other ingredients of the composition and should not adversely affect them or itself be adversely affected by the other ingredients. Suitable thickening agents include colloidal magnesium aluminum silicate (Veegum), hydroxyethyl cellulose, sodium carboxymethyl cellulose, sodium carboxyethyl cellulose, bentonite, alginates, amylopectin starch, carboxy vinyl polymers, xanthan gums, fumed amorphous silica, precipitated silica and the like. The type and amount of thickening agent can be selected to provide a pseudo-plastic composition having a viscosity of between about 300 to about 1500 cps., preferably about 400 to about 900 cps. as determined on a Brookfield LVT viscometer using a No. 2 spindle at 12 rpm.

The proportion of thickening agent, if used, is not narrowly critical and can range from about 0 wt.% to about 10 wt.%, preferably from about 0 wt.% to about 5 wt.% based on the total weight of the water, amine and water-soluble organic solvent, if any, in the novel compositions. The proportion of thickening agent depends largely on the thickening ability of the agent. The thickening agent can be mixed into the composition before or after the water-soluble organic amine is neutralized by treatment with carbon dioxide.

The novel compositions can contain other optional ingredients insofar as they do not interfere with the cleaning ability of the compositions or adversely affect the other ingredients of the compositions.

Surfactants of various kinds can also be added to augment the cleaning power of the compositions. Small amounts of a wax, such as beeswax, scale wax (crude) or paraffin wax, in pulverized form can be added to improve the adherence of the compositions to the unwanted coating desired to be removed. Such waxes are solids at room temperature and soften in the range of 100° F. to 200° F. The novel compositions can be employed as foams in which case foam stabilizers of the well known types are added to the solutions which are then packaged in aerosol containers with suitable propellants.

Carbon dioxide can be used as a propellent when the novel compositions are packaged in aerosol containers and, when so used, also functions to provide a $CO_2$ atmosphere for maintaining the pH of the compositions at or near neutral. Alternatively, other conventional propellants can also be employed in the aerosol container. Such other propellants include the hydrocarbons such as isobutane and isobutane/propane mixtures, halocarbons such as dichlorodifluoromethane, trichlorofluoromethane, dichlorotetrafluoroethane, and 1,1,2-trichlorotrifluoroethane or mixtures thereof, or any other suitable propellant which is effective at atmospheric temperatures and does not adversely react with any components of the composition. The aerosol container unit consists of a pressure-tight aerosol container having a valve-controlled opening and containing the novel composition as set forth therein and from about 1.00 wt.% to about 25.00 wt.% of a propellant based on the weight of said composition. The aerosol container unit can be adapted to provide a fine spray or foam upon activation of the valve. The novel compositions can be first prepared and then added to the aerosol container or the aqueous solution of the water-soluble organic amine and other ingredients can be added to the aerosol container which can then be pressurized with carbon dioxide to neutralize the amine solution and provide the internal pressure needed to propel the composition from the container. Alternatively, the novel compositions can be packaged in non-aerosol containers, such as jars or bottles, under about one atmosphere of $CO_2$.

Treatments of the unwanted coatings to loosen and/or soften same according to this invention can be effected in a variety of ways, the following being typical examples:

(a) Application of the novel composition by means of a sponge, brush or cloth.

(b) Application of the novel composition by means of a hand operated spray bottle or a hand pump or automatically (e.g., by venturi action) by means of a cartridge of compressed gas.

(c) Application of the novel composition in gel or paste form.

(d) Application of the novel composition by means of an aerosol type pressurized dispenser.

The novel composition can be applied to the unwanted coating which is at ambient temperature and allowed to stand thereon at ambient temperature or the temperature can be raised, e.g., to 80° or 90° C. more or less and held there for a period of a few minutes to three or more hours. Alternatively, the temperature of the unwanted coating can be elevated, e.g., to 80° or 90° C., more or less, followed by application of the novel composition and the temperature can be maintained at that level or increased or allowed to decrease. The time required to loosen or soften the unwanted coating sufficiently to facilitate mechanical removal depends largely upon the temperature used and on the stubbornnesss of the unwanted coating to loosening or softening. Even the toughest, unwanted coatings in cooking ovens can usually be loosened or softened sufficiently for removal within 30 minutes, especially at the higher temperatures, to 2 to 3 hours or more at room temperature. If the novel composition applied as an over-coating on the unwanted coating dries out before the unwanted coating has sufficiently loosened or softened, additional amounts of the novel composition can be applied. In general, however, even the toughest coatings in cooking ovens are removed in one application.

After loosening or softening, the loosened or softened unwanted coating can be mechanically removed by washing, scraping, wiping, scrubbing or flushing with water, if feasible, or by any other means available or convenient to the user. The novel composition of this invention, when tested for toxicity and irritation, was found to be not "toxic" by the standard of the Federal Hazardous Substances Act (FHSA) and was found not to be a skin irritant according to the FHSA standards, unlike a popular commercial brand oven cleaner which contained caustic alkali. The commercial brand oven cleaner was found to be considerably more toxic and irritating than the novel composition. The pH's of the novel compositions are initially low and remain relatively low (for example below 10) throughout the operation. This phenomenon was unexpected and indicates that high pH's are not essential to achieve a satisfactory attack on the unwanted coating and that the novel compositions can be substantially as safe during and after the cleaning as they were before it was applied or in the initial stages of application.

The following examples are presented to illustrate the invention. Numbered Examples refer to $CO_2$-neutralized organic amine compositions and except as noted, illustrate this invention. Lettered Examples do not refer to $CO_2$-neutralized organic amine compositions and thus are not illustrative of the invention claimed herein. Unless otherwise specified, all parts, ratios and percentages are on a weight basis, all temperatures are on the Centigrade scale, and pH's were determined with pH paper. The percent soil removal values given in the examples were determined by visual inspection and estimation of the percentage of the area of baked-on soil removed by the composition being tested. The tests were continued until all baked-on soil could be removed by rinsing in water and wiping with a sponge, or until the composition being tested had dried out.

In the examples, the following designations are used as abbreviations for the following bases:

TABLE 1

| Designation | Base |
|---|---|
| MEA | Monoethanolamine |
| AC | Ammonium Carbonate |
| M | Morpholine |
| DEA | Diethanolamine |
| TEA | Triethanolamine |
| NBA | N-Butylamine |
| DBA | Di-N-Butylamine |
| TPA | Tri-N-Propylamine |
| NaOH | Sodium Hydroxide |
| AH | Ammonium Hydroxide |
| APEE | 2-[2-(3-Aminopropoxy) ethoxy]ethanol |
| $Ca(OH)_2$ | Calcium Hydroxide |

In the examples, the following designations are used as abbreviations for the following solvents:

TABLE 2

| Designation | Solvent |
|---|---|
| BEE | 2-(2-butoxyethoxy) ethanol |
| TBE | Triethylene glycol monobutyl ether |
| TME | Triethylene glycol monomethyl ether |
| PE | Mixture of 70 parts 2-phenoxyethanol, and 30 parts 2-(2-phenoxyethoxy)ethanol, |
| BEP | 1-Butoxy-2-Ethoxypropanol |
| HG | Hexylene Glycol |
| TPM | Tripropylene glycol monomethyl ether |
| MME | 2-Methoxy-1-methylethanol |
| EG | Ethylene Glycol |
| DEG | Diethylene Glycol |
| TEG | Triethylene Glycol |
| PG | Propylene Glycol |
| MEE | 2-(2-methoxyethoxy) ethanol |
| ME | 2-methoxyethanol |

The "composite soil" used in most of the examples was prepared by mixing the following ingredients in a baking dish:

| Ingredient | Amount (g) |
|---|---|
| Peanut oil | 90 |
| Corn oil | 50 |
| Cherry pie mix | 50 |
| Ground beef | 50 |
| Ground pork | 50 |
| Corn Syrup | 50 |
| NaCl | 2 |
| Water | 50 |

The mixture was heated for two hours at 400° F. and then liquid was drained off and separated from the solids. The liquid was used as the composite soil by applying it to and baking it on a surface. This procedure is similar to the one set forth in Proposed Federal Specification P-C-1947 "Cleaning Compound, Oven" (Aerosol—for indoor occupied areas) GAS Jan. 2, 1975 which also includes 2 grams sodium glutamate, but does not contain Corn syrup.

A "carbohydrate soil" is used in some of the following examples and was made pursuant to the above-identified Federal Specification by mixing the following ingredients in a food blender for 10 minutes at 100° F.:

| Ingredient | Amount (g) |
|---|---|
| Commercial Cheese Spread | 80 |
| Dehydrated instant au gratin potatoes | 80 |
| Sugar | 160 |
| Vegetable oil | 23 |

EXAMPLES 1, A AND B

In Example 1, 10 grams of 2-(2-butoxyethoxy)ethanol (BEE), 10 grams of monoethanolamine (MEA) and 80 grams of water were placed in an aerosol can and a valve was affixed to the can. The can was filled with $CO_2$ and vented three times. The contents then were pressurized with $CO_2$ gas until the equilibrium interior pressure reached about 90 psig. Whenever the can became warm, it was shaken until it cooled before continuing with the above procedure.

In Example B, a commercial oven cleaner, Dow Oven Cleaner, made by Dow Chemical Company was employed as the cleaning composition. The Dow Oven Cleaner used contained water, 10% glycol ethers, 5% alkanolamines, 4% propellant, 4% sodium hydroxide and less than 1% each of inert cleaning aids, thickener, nonionic surfactants and perfume, according to label.

In Example A, 10 grams of MEA was dissolved in water. Then, 10 grams of BEE was also dissolved in the water to provide a composition containing 10 grams MEA, 10 grams BEE and 80 grams of water.

Each of the compositions of Examples 1, A and B was tested by the following procedure. Glass microscope slides were coated with a thin but thorough coating of "composite soil" and then baked at 246° C. (475° F.) for 1.5 hours. Smooth and even baked soil surfaces were used for subsequent testing. A section broken from a baked, soiled slide was placed in a 50 ml. beaker with the baked, soiled side up. Five grams of the cleaning composition under test was placed on the baked, soiled surface. The beaker was placed in a 90° C. (193° F.) oven and checked every 30 minutes for percentage of soil removal. When 100% of the soil was removed or the cleaning composition had evaporated the test was terminated. The results are given in Table 3 below.

TABLE 3

| Example | Base | Solvent | % Soil Removal 1 hr. | 1.5 hr. |
|---|---|---|---|---|
| 1 | MEA | BEE | 75 | 100 |

TABLE 3-continued

| Example | Base | Solvent | % Soil Removal 1 hr. | 1.5 hr. |
|---|---|---|---|---|
| A | MEA | BEE | 100 | — |
| B | DOW OVEN CLEANER* | | 0 | 100 |

*Consumer product on market

EXAMPLES 2-7 AND C TO H

In these examples, various amine bases were tested as 10 wt.% mixtures in an aqueous solution containing 10 wt.% BEE. In Examples 2-7, $CO_2$ was added by adding dry ice to each cleaning composition until the pH was reduced into the range of 7 to 8. The identities of the amines tested and the results obtained expressed in terms of percent of soil removed are given in Table 4 below. The preparation and testing procedures given in Examples 1, A and B were used.

TABLE 4

| | Percent Soil Removal - Various Amines | | | | | | | | | | | |
|---|---|---|---|---|---|---|---|---|---|---|---|---|
| Example | 2 | 3 | 4* | 5 | 6 | 7* | C | D | E | F | G | H |
| Base | NBA | DBA | TPA | MEA | DEA | TEA | NBA | DBA | TPA | MEA | DEA | TEA |
| 30 min. | 0 | 0 | 0 | 0 | 0 | 0 | 100 | 20 | 0 | 50 | 0 | 0 |
| 1 hr. | 0 | 0 | 0 | 100 | 0 | 0 | 100 | 95 | 10 | 100 | 0 | 0 |
| 1.5 hrs. | 50 | 0 | 0 | 100 | 5 | 0 | 100 | 100 | 40 | 100 | 0 | 0 |
| 2 hrs. | 100 | 0 | 0 | 100 | 25 | 0 | 100 | 100 | 45 | 100 | 0 | 0 |
| 2.5 hrs. | 100 | 0 | 0 | 100 | 30 | 0 | 100 | 100 | 45 | 100 | 0 | 0 |
| 3 hrs. | 100 | 5 | 0 | 100 | 100 | 0 | 100 | 100 | 45 | 100 | 100 | 0 |
| 3.5 hrs. | 100 | 5 | 0 | 100 | 100 | 0 | — | — | — | — | — | — |
| 4 hrs. | 100 | 5 | 0 | 100 | 100 | 0 | — | — | — | — | — | — |

*Examples 4 and 7 are $CO_2$ neutralized tertiary amine compositions not within the scope of this invention.

EXAMPLES 8, 9, I AND J

The following compositions given in Table 5 were prepared and tested by the procedure set forth in Examples 1, A and B. In Examples 8 and 9 the respective compositions as given in Table 5 were treated with $CO_2$ (dry ice) until the pH dropped into the range of 7 to 8. The results obtained expressed percent of soil removed are given in Table 6.

TABLE 5

| Example | Ingredients | % by Weight |
|---|---|---|
| I | APEE | 10 |
| | $H_2O$ | 90 |
| J | APEE | 10 |
| | BEE | 10 |
| | $H_2O$ | 80 |
| 8 | Same as Ex. J + $CO_2$ | |
| 9 | Same as Ex. I + $CO_2$ | |

TABLE 6

| | Percent Soil Removal | | | |
|---|---|---|---|---|
| Example | I | J | 8 | 9 |
| 30 mins. | 0 | 0 | 0 | 0 |
| 1 hr. | 0 | 50 | 50 | 0 |
| 1.5 hrs. | 0 | 100 | 95 | 0 |
| 2 hrs. | 5 | 100 | 100 | 5 |
| 2.5 hrs. | 50 | 100 | 100 | 10 |
| 3 hrs. | 90 | 100 | 100 | 100 |
| 3.5 hrs. | 100 | 100 | 100 | 100 |
| 4 hrs. | 100 | 100 | 100 | 100 |

EXAMPLES K-M

Three compositions were prepared using the procedures of Example 1, A and B and the materials listed in Table 7.

TABLE 7

| | K | L | M |
|---|---|---|---|
| Saturated aqueous CaOH solution (g) | 100 | 90 | 90 |
| BEE (g) | 0 | 10 | 10 |

The composition of M was treated with $CO_2$ until the pH was lowered to about 7. Each composition was tested pursuant to the procedures given in Example 1, A and B and after 2.5 hours no soil whatsoever had been removed by any of the three compositions.

EXAMPLE N 4.5 wt. parts of NaOH and 95.5 wt. parts water were mixed in a beaker and tested pursuant to the procedures given in Examples 1, A and B. The resulting solution had a pH of 13.8 measured by a pH meter. When tested on glass slides there was 0% soil removal after 1 hour, 70% after 2 hours and 100% soil removal after 3 hours.

Examples 10–12 AND O–T

Ten compositions as described in Table 8 were prepared using the procedures described in Table 9. Porcelainized enamel panels were coated with a thin, but thorough coat of the composite soil described hereinbefore and baked at 246° C. (475° F.) for 1.5 hours. Smooth and even baked soil surfaces were used for subsequent testing. In each case, the cleaning composition was coated onto the baked soiled panel and placed in a 90° C. oven. Each panel was checked periodically for percent of soil removal and the results are correspondingly given in Table 8. The panels are kept in the oven until all soil was removed or until the composition coating dried out.

TABLE 9-continued

| Example | Preparation |
|---|---|
| | valve (4 inch × 0.025 inch stem and 0.080 inch body was affixed). The can and contents were pressurized with $CO_2$ gas until the internal pressure reached 90 psig. The can was vented and pressurized three times before final pressurizing to 90 psig. A 0.020 inch actuator was then attached to the valve. |
| P | Dow Oven Cleaner purchased at random. |
| Q | The solvent and water were mixed and placed in a Waring blender and whipped while adding the thickener. The resulting composition was packaged in an aerosol can in the manner described in Example 10. |
| 11 | The water was heated to 50 to 60° C. and placed in a Waring blender. The blender was turned on "low" and the thickener was sprinkled in. Thereafter, the base and solvent were added while the blender agitated the mixture and thereafter the blender was turned on "high" for two minutes. The resulting composition was packaged in an aerosol container in the manner described in Example 10 except that whenever the can became warm during pressurization with $CO_2$ gas it was shaken until cooled to room temperature before continuing with the pressurization. |
| R | The water was heated to 50 to 60° C. and placed in a Waring blender. The blender was turned on "low" and the thickener sprinkled in. Thereafter, the base and solvent were added while the blender was on and then the completed composition was mixed on "high" for two minutes. |
| S | The same procedure as used in Example R was employed except that chunks of solid $CO_2$ were added to the finished composition in the Waring blender until the pH was reduced to 8 or below. |
| T | The procedure described in Example R was used. |
| | The procedure described in Example 12 was used. |

TABLE 8

| Ex. | Base Type | Base Amt.(g) | Solvent Type | Solvent Amt.(g) | Thickener Type | Thickener Amt.(g) | $H_2O$(g) | $CO_2$ | % Soil Removal 20 mins. | 30 mins. | 35 mins. | 40 mins. | 4 hrs. |
|---|---|---|---|---|---|---|---|---|---|---|---|---|---|
| O | MEA | 10 | TPM | 10 | V | 10 | 80 | 76 | — | 100 | — | — | — |
| 10 | " | 10 | BEE | 10 | C | 1 | 80 | NO YES | 98 | — | — | — | — |
| P | DOW OVEN CLEANER | | | | | | | | 100 | — | — | — | — |
| Q | — | — | BEE | 15 | C | 2 | 83 | YES | — | 0 | — | — | — |
| 11 | MEA | 10 | BEE | 10 | V | 2 | 78 | YES | — | — | 100 | — | — |
| R | MEA | 10 | TPM | 10 | V | 1 | 79 | NO | — | — | — | 100 | — |
| 12 | M | 10 | — | — | — | — | 90 | YES | — | — | — | 100 | — |
| S | NaOH | 7 | TPM | 10 | V | 1 | 82 | NO | — | — | — | 100 | — |
| T | " | 7 | " | 10 | V | 1 | 82 | YES | — | — | — | 0 | — |

V designates Veegum T, a colloidal magnesium aluminum silicate made and sold by R. T. Vanderbilt Co., Inc.
C designates a hydroxyethyl cellulose having a viscosity, as a 2 wt. % aqueous solution, of 5401 to 6100 cps as determined at 25° C. on a Brookfield LVT Viscometer at 60 rpm using a #4 spindle.
—designates no measurement made

TABLE 9

| Example | Preparation |
|---|---|
| O | The base, solvent and water were mixed and heated to 60 to 70° C. Then the mixture was vigorously stirred and the thickener was added. |
| 10 | The base, solvent and water were mixed in a beaker and dry ice (solid $CO_2$) was added until the pH (measured with pH paper) was reduced to 8 or lower. Thereafter, the composition was placed in a Waring blender and whipped while adding the thickener. The resulting composition was placed in an eight-ounce, double-lined aerosol can (vinyl/epoxy) and a |

EXAMPLES 13, 14 AND U

Seven compositions as described in Table 10 were prepared using the procedures described in Table 11. Porcelainized enamel test panels soiled as described in Examples 10–12 and O-T were used. Smooth and even cured surfaces were used for testing. Prior to coating with each composition, each panel was warmed in a 90° C. oven. Thereafter, it was coated with the composition under test, placed in a 90° C. oven and periodically visually checked for percent soil removal. The results are given in Table 10. The panels were kept in the oven until all soil was removed or until the composition coating dried out.

TABLE 10

| Example | Base Type | Base Amt. (g) | Solvent Type | Solvent Amt. (g) | Thickener Type | Thickener Amt. (g) | $H_2O$ (g) | $CO_2$ | % Soil Removal 15 mins. | 20 mins. | 30 mins. |
|---|---|---|---|---|---|---|---|---|---|---|---|
| 13 | MEA | 10 | TPM | 10 | — | — | 80 | YES | — | — | 25 |
| U | DOW OVEN CLEANER | | — | — | — | — | — | NO | 25 | — | — |
| 14 | MEA | 10 | BEE | 10 | V | 19 | 80 | YES | — | 20 | 80 |

TABLE 10-continued

| Example | Base Type | Base Amt. (g) | Solvent Type | Solvent Amt. (g) | Thickener Type | Thickener Amt. (g) | $H_2O$ (g) | $CO_2$ | % Soil Removal 15 mins. | 20 mins. | 30 mins. |
|---|---|---|---|---|---|---|---|---|---|---|---|
| 10 | MEA | 10 | BEE | 10 | C | 1 | 80 | YES | — | 98 | — |

V designates Veegum T, a colloidal magnesium aluminum silicate made and sold by R.T. Vanderbilt Co., Inc.
C designates a hydroxyethyl cellulose having a viscosity, as a 2 wt.% aqueous solution, of 5401 to 6100 cps as determined at 25° C. on a Brookfield LVT Viscometer at 60 rpm using a #4 spindle.
—designates no measurement made

TABLE 11

| Example | Preparation |
|---|---|
| 13 | The base, solvent and water were mixed together and then placed in an aerosol can and pressurized pursuant to the procedure described in Example 10 with the exception that, whenever the can became warm, it was shaken until cooled to room temperature before continuing with the pressurization. |
| V | Dow Oven Cleaner |
| 14 | The base, solvent and water were mixed and heated to 50 to 60° C. Solid $CO_2$ was added until the pH was reduced to 8 or less. Thereafter, the composition was placed in a Waring blender and whipped while adding the thickener. |
| 10 | See Table 9. |

EXAMPLES 15 and V

The composition of Example V was prepared by mixing 15 grams BEE and 83 grams of water in a beaker. Thereafter, the mixture was placed in a Waring blender and whipped while two grams of a hydroxyethyl cellulose thickner were added. The resulting composition was packaged in an aerosol container using the procedure described for Example 10, Table 9.

The composition of Example 15 was prepared by mixing 28.5 grams of water and 10 grams of monoethanolamine and adding solid $CO_2$ until the pH was reduced to 8 or less. 50 grams of water were heated to 50 to 60° C. and placed in a Waring blender. The blender was turned on "low" and the thickener was sprinkled in. While agitating the mixture of water and thickener, 10 grams of BEE were added. Then, the mixture of base and water treated with $CO_2$ were added to the blender while continuing agitation. Thereafter, the resulting composition was whipped on "high" in the blender for two minutes. The resulting composition was packaged in an aerosol container in the manner described for Example 10 in Table 9.

In each instance, the two above-mentioned compositions were tested on porcelainized enamel panels soiled with the composite oven soil. The soiled panels were prepared in the same manner as the soiled panels described in Examples 10–12 and O-T. After the panels were coated with the cleaning composition, they were allowed to stand at room temperature and observations were made periodically for percent soil removal. The composition of Example V provided 0% soil removal after 48 hours. The composition of Example 15 provided 100% solid removal after 17 hours.

EXAMPLES 16 and W

Two identical compositions were made, each containing 10 grams monoethanolamine (MEA), 10 grams of BEE and 80 grams of water. In the composition of Example 16 the above-mentioned mixture was neutralized with solid $CO_2$ to a pH of 8 or less whereas the composition of Example W was not.

5 grams of each resulting cleaning composition was placed in a 50 ml. beaker which was then placed in a 90° C. oven. The pH of each mixture in the oven was taken periodically and the results are given in Table 11 below.

Every 30 minutes one ml. of water was added to each mixture to replace evaporated water. These Examples illustrate the substantial effectiveness of the present invention in maintaining the pH of the cleaning composition well below 10 while it is being used in a typical manner to clean an oven. The results are plotted in the graph of the drawing.

TABLE 12

| Example | pH Comparison W | 16 |
|---|---|---|
| 0 hrs. | 11.6 | 7.8 |
| 30 mins. | 11.5 | 9.5 |
| 1 hr. | 11.4 | 9.6 |
| 2 hrs. | 11.0 | 9.7 |
| 3 hrs. | 10.8 | 9.9 |

EXAMPLES 17 AND X

In the case of Example 17, a composition was prepared containing 10 grams of monoethanolamine (MEA), 10 grams of BEE and 80 grams of water. Carbon dioxide was added to saturate the composition and reduce its pH to a range of 7 to 8. The composition of X was Dow Oven Cleaner which is a commercial product. The two compositions were tested on porcelainized enamel panels which were coated with the "carbohydrate soil" described hereinabove and baked on the panels at 191° C. for two hours.

Two sets of tests were conducted. In the first set, the soiled panels were at room temperature when coated with the compositions of Examples 17 and X. They were then placed in a 100° C. oven and observations of percent soil removal were made. The results of these observations are given in Table 13 below.

In the second set, the soiled panels were first heated to 100° C. before the compositions of Examples 17 and Z were coated onto them. After coating, the panels were heated in a 100° C. oven and observations were made of the percent soil removal. The results are given in Table 13 below.

TABLE 13

| % Soil Removal | | |
|---|---|---|
| Panels initially cool Minutes | X | 17 |
| 30 | 90 | 50 |
| 45 | 95 | 85 |
| Panels initially hot Minutes | X | 17 |
| 30 | 98 | 75 |
| 45 | 98 | 98. |

EXAMPLE 18

A composition was prepared containing 10 grams monoethanolamine (MEA), 10 grams of BEE, 78.5 grams water and 1.5 grams colloidal magnesium aluminum silicate using the procedure described in Example R. Thereafter, solid $CO_2$ was added until the composition was saturated at one atmosphere at room temperature. This took about 9.5 grams of $CO_2$. 96 wt. parts of the composition and 4 wt. parts of isobutane propellant were charged into an aerosol container in a typical manner. The resulting oven cleaning composition was quite effective, contained no caustic alkali and was not a skin irritant based on animal tests whereas a leading caustic alkali-containing oven cleaner on the market had to be classified as a skin irritant pursuant to FHSA definition. Additionally, the composition of Example 18 was considerably less irritating to the eye according to animal testing than a leading caustic alkali-containing oven cleaner on the market. The composition of Example 18 was found to be not toxic, by FHSA definition, following acute peroral or covered dermal routes of administration. The substantially saturated vapor evolved from the composition of Example 18 at room temperature under static conditions was not toxic by FHSA standards and products resulting from heating the composition of Example 18 at 85° C. for two hours and twenty-five minutes did not kill test animals (rats) after that period of exposure. Overall, the commercial caustic alkali-containing oven cleaner tested was found to be considerably more toxic and irritating than the composition of Example 18 with the exception of inhalation results in which both cleaners were found to be non-toxic.

What is claimed is:

1. A water-based composition having a pH of 10 or less capable of loosening or softening an unwanted organic coating bonded to a surface, comprising a mixture of an aqueous solution containing from about 1 to about 20 weight percent of one or more water-soluble secondary or primary amines based on the total weight of the solution, said amine being neutralized with $CO_2$ in the solution in an amount sufficient to cause said solution to have a pH of 10 or less, said solution being capable of releasing said amine and carbon dioxide into said solution when said solution is subjected to conditions wherein the partial pressure of carbon dioxide acting on the solution is less than the partial pressure of carbon dioxide in said solution at the temperature at which the composition is used to clean said surface, said amine having a boiling point in excess of the temperature at which the composition is used for cleaning said surface and being capable, alone or in conjunction with a water-soluble solvent, of loosening or softening said coating on said surface; said solution additionally containing from 0 to about 50 weight percent of a water-soluble organic solvent based on the weight of the solution and a thickening agent in an amount sufficient to increase the viscosity of said mixture so that it will stick on said unwanted coating.

2. A water-based cleaning composition as claimed in claim 1 wherein said composition has a pH of less than about 8.

3. A water-based cleaning composition as claimed in claim 1 wherein said composition contains about 5 to about 20 wt.% of a water-soluble organic solvent based on the total weight of said composition.

4. A water-based cleaning composition as claimed in claim 2 wherein said amine is monoethanolamine.

5. A water-based cleaning composition as claimed in claim 4 wherein said composition also contains 2-(2-butoxyethoxy)ethanol as a water-soluble solvent.

6. An aerosol container containing a water-based cleaning composition having a pH of 10 or less capable of loosening or softening an unwanted organic coating bonded to a surface, comprising an aqueous solution containing from about 1 to about 20 weight percent of one or more water-soluble secondary or primary amines based on the total weight of the composition, said amine being neutralized with $CO_2$ in the solution in an amount sufficient to cause said solution to have a pH of 10 or less, said solution being capable of releasing said amine and carbon dioxide into said solution when said solution is subjected to conditions wherein the partial pressure of carbon dioxide acting on said solution is less than the partial pressure of carbon dioxide in said solution at the temperature at which the composition is used to clean said surface, said amine having a boiling point in excess of the temperature at which the composition is used for cleaning said surface and being capable, alone or in conjunction with a water-soluble solvent, of loosening or softening said coating on said surface; and said solution additionally containing from 0 to about 50 weight percent of a water-soluble organic solvent based on the total weight of the composition and pressurized with a propellant.

7. An aerosol container according to claim 6 wherein said composition contains a thickening agent in an amount sufficient to increase the viscosity of said composition so that it will stick on said unwanted organic coating.

8. An aerosol container as claimed in claim 7 wherein said propellant is carbon dioxide.

9. An aerosol container as claimed in claim 7 wherein said propellant is a liquefied, normally gaseous, hydrocarbon aerosol propellant.

10. Method of removing or softening an unwanted organic coating bonded to a surface, comprising the steps of applying to said coating an aqueous composition containing from about 1 to about 20 weight percent of one or more water-soluble secondary or primary organic amines based on the total weight of the composition said amine being neutralized with $CO_2$ in the composition in an amount sufficient to cause said composition to have a pH of 10 or less, said composition being capable of releasing said amine and carbon dioxide into said composition when said composition is subjected to conditions wherein the partial pressure of carbon dioxide acting on the composition is less than the partial pressure of carbon dioxide in said composition at the temperature at which the composition is used to clean said surface, said amine having a boiling point in excess of the temperature at which the composition is used for cleaning said surface and being capable, alone or in conjunction with a water-soluble organic solvent, of loosening or softening said coating on said surface, said composition additionally containing from about 0 to about 50 weight percent of a water-soluble organic solvent based on the total weight of the composition; subjecting the composition applied to said coating to said conditions to soften or loosen said coating; and thereafter mechanically removing said coating.

11. Method as claimed in claim 10 wherein the composition applied to the coating is heated to provide said conditions wherein the partial pressure of carbon dioxide gas acting on the composition is less than the partial pressure of carbon dioxide in said composition.

12. A method according to claim 10 wherein said aqueous composition has a pH of less than about 8.

13. A method according to claim 10 wherein said aqueous composition contains from about 5 to about 20 weight percent of a water-soluble organic solvent based on the total weight of said composition.

14. A method according to claim 13 wherein said aqueous composition also contains up to 10 weight percent of a thickening agent based on the total weight of said composition.

15. A method according to claim 10 wherein said amine is monoethanolamine.

16. A method according to claim 15 wherein said composition also contains 2-(2-butoxyethoxy) ethanol as a water-soluble solvent.

17. Method of making a water-based cleaning composition having a pH of 10 or less capable of loosening and/or softening an unwanted coating bonded to a surface, comprising, contacting an aqueous solution containing from about 1 to about 20 weight percent of one or more water-soluble secondary or primary organic amines based on the total weight of the solution with solid carbon dioxide until the pH of said solution falls below about 10 to form an aqueous solution containing said amine neutralized with $CO_2$, said solution being capable of releasing said amine and carbon dioxide into the said solution when said solution is subjected to conditions wherein the partial pressure of carbon dioxide acting on the solution is less than the partial pressure of carbon dioxide in said solution at the temperature at which the composition is used to clean said surface, said amine having a boiling point in excess of the temperature at which the composition is used for cleaning said surface and being capable, alone or in conjunction with a water-soluble organic solvent of loosening or softening said coating on said surface, and adding to said solution from 0 to about 50 weight percent of a water-soluble organic solvent based on the total weight of the solution.

18. Method as claimed in claim 17 wherein said solution is contacted with $CO_2$ until the pH of said solution reaches about 8 or less.

19. Method as claimed in claim 17 wherein said contacting is carried out in an aerosol container.

* * * * *